United States Patent [19]

Englehart

[11] Patent Number: 4,707,925

[45] Date of Patent: Nov. 24, 1987

[54] DOOR FRAME PATTERN DEVICE

[76] Inventor: Clem C. Englehart, 304 Animas St., Aztek, N. Mex. 87410

[21] Appl. No.: 853,869

[22] Filed: Apr. 21, 1986

[51] Int. Cl.[4] ..... E04F 21/00

[52] U.S. Cl. ..... 33/194; 33/562; 269/905

[58] Field of Search ..... 269/111, 113–114, 269/118–121, 296, 302, 904–905; 33/194, 562

[56] References Cited

U.S. PATENT DOCUMENTS

| | | | |
|---|---|---|---|
| 1,115,030 | 10/1914 | Smith | 33/194 |
| 1,917,239 | 7/1933 | Chester | 33/194 |
| 2,679,696 | 6/1954 | Reeder, Jr. | 33/194 |
| 2,684,090 | 7/1954 | Bernitz | 33/194 X |
| 3,126,644 | 3/1964 | Dale | 33/194 |
| 3,200,509 | 8/1965 | Stephens | 33/194 |
| 3,284,912 | 11/1966 | Hoven | 33/194 |
| 3,930,315 | 1/1976 | Baskett | 33/194 |

*Primary Examiner*—Frederick R. Schmidt
*Assistant Examiner*—Steven P. Schad

[57] ABSTRACT

A device which can be placed in a door frame, set and adjusted to the precise dimensions of the door frame; then removed and placed on the door, providing a means for indicating the amount and location of planing to be done to a door to insure a precise fit when the door is hung.

7 Claims, 3 Drawing Figures

DOOR FRAME PATTERN DEVICE

SUMMARY

This device is designed to provide people who hang doors with an adjustable tool for establishing the pattern of a door frame, which is then transferred to the door, allowing the door to be planed to a precise fit before the door is hung. It is an objective of this invention to minimize or eliminate wasteful time needed to fit a door to a door frame by trial and error methods, and to eliminate the construction of temporary one-time useable door frame patterns. The reuseable, adjustable door frame pattern which quickly and easily adjusts to a wide variety of door frame sizes reduces the time and labor of hanging doors, thus increasing the efficiency of the personnel with a resultant savings in cost. A further objective of the invention is to provide a safe, economical tool which is within the means of a small business, even an individual, contracting to hang doors.

DESCRIPTION OF THE PRIOR ART

1. Field of the Invention.

This invention relates to construction industry hand tools, and more specifically to door frame patterns.

2. Description of the Prior Art.

It is very common among door hangers to measure door frames, apply the measurements to a door, then preform preliminary planing. Usually the door is then placed in the frame, and additional planing requirements established, and preformed before a final fit is achieved. Depending upon the expertise of the door hanger, several measuring and planing operations may be required to obtain a satisfactory fit. It is not uncommon for a door hanger to build out of wood, a pattern of the door frame which can be used to transfer the door frame pattern onto the door. However the use of such makeshift pattern lack precision, are one-time useable, and take substantial time to make.

DESCRIPTION OF THE PREFERRED EMBODIMENT

Figure 1:
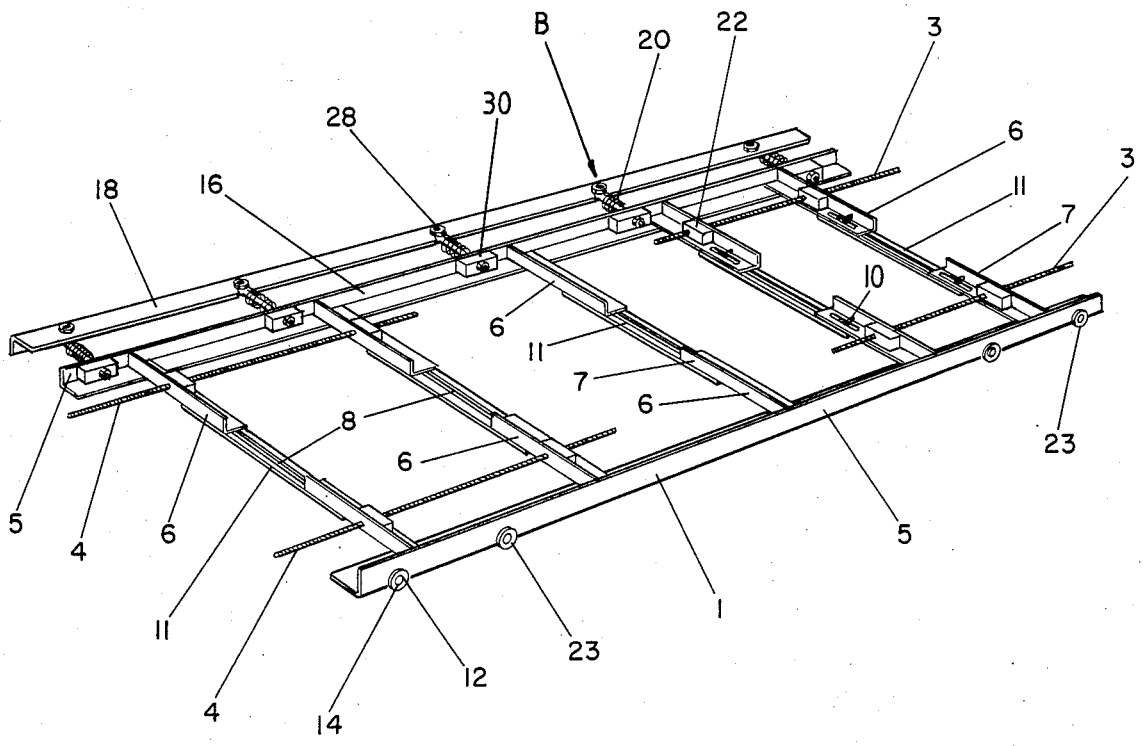
FIG. 1 is an isometric view of the invention.

As shown in FIG. 1 the invention has an adjustable frame 1, a plurality of top screw rods 3, and a plurality of bottom screw rods 4, and a pressure plate 18. The frame 1 is made of rigid material, and has two side beams 5 and a plurality of cross beams 6. Angle metal has been found to be very satisfactory for the frame 1 and the pressure plate 18. When using angle metal, one flange of the metal, such as aluminum, in the side beams 5 and cross beams 6 should be in one plane which will be a smooth side to be placed on a door without scratching the door. The angle metal used in the pressure plate 18 should be oriented so that a flange of the metal is parallel to, but in a different plane than the smooth side so that a definite edge is to be bearing on the door. It has been found that five cross beams 6 are sufficient for most uses; however more or less may be employed as required by size. Each cross beam 6 consists of two slotted arms 7, each slotted arm 7 being rigidly affixed at right angles to one of the side beams 5 in a smooth non-scratching manner such as by flush riveting. The slotted arms 7 have longitudinal slots 8 sized to accept a carriage bolt 9. One or more bolts 9 may pass through the slots 8 in each cross beam 6 and opposing slotted arms 7, from the smooth side to the interior of the right angle of the angle metal are secured to each other by a nut 10 on the bolt 9. The nuts 10 are shown as wing nuts, however any standard nut may be used. Thus the frame 1 is adjustable in width by loosening the nuts 10 on all cross beams 6, setting the width of the side beams 5 and tightening the nuts 10; and the smooth heads of the carriage bolts 9 are on the smooth side of the frame 1. It should be pointed out that the slotted arms 7 may be angle or channel metal to insure that the squareness of the frame 1 is retained; however tubing allowing one slotted arm 7 to slide into and out of the opposing slotted arm 7, or extension beam 11, as well as any other similar design, may be used. In addition, to increase the adjustability of the frame 1, extension beams 11 slotted similar to the slotted arms 7 may be used to connect opposing slotted arms 7, as shown in FIG. 1. The extension beams 11 are affixed to the slotted arms 7 by carriage bolts 9 and nuts 10 in a manner similar to the aforementioned method of affixing opposing slotted arms 7. One of the side beams 5, designated clearance rail 15 has on its edge a plurality of clearance means 12. The clearance means 12 are shown as simple bolts 13 and washers 14 rigidly affixed to the outside of the clearance rail 15 to provide approximately three-sixteenths of an inch clearance along a vertical side of the door frame. This clearance provides the standard three-thirty seconds of an inch, as required by architects, on each side of the door. It is obvious however than an adjustable clearance means 12 such as a screw threaded through the clearance rail 15 may be employed to provide a means for adjusting the clearance for specialized useage. The clearance means 12 are disposed adjacent to the ends of the clearance rail 15. There are four clearance means 12 shown, two disposed toward the top and two disposed toward the bottom. By providing two clearance means 12 at each end, the possibility of a single clearance means 12 at either end falling into a pre-cut hinge mounting notch is avoided.

Figure 2:
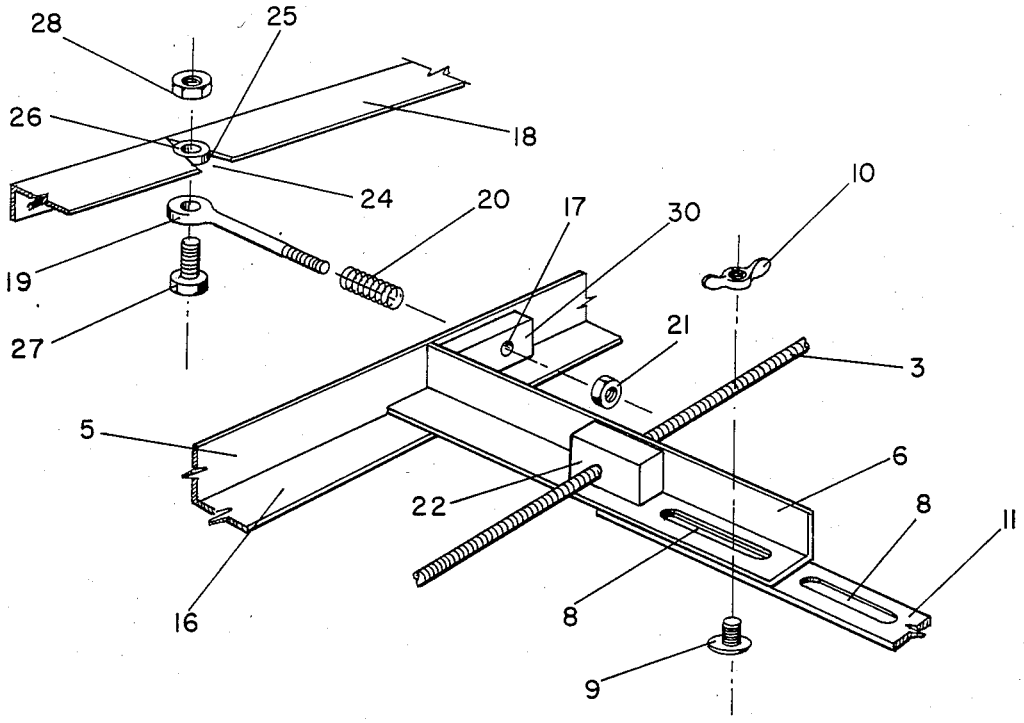
FIG. 2 is an enlarged isometric exploded view of an area generally indicated by the letter B in FIG. 1.

The other side beam 5 is designated the spring rail 16. The spring rail 16 has a plurality of equally spaced blocks 30 in the angle of the angle metal and bolt holes 17 through the spring rail 16 and the blocks 30. The pressure plate 18 being a rigid longitudinal member of angle metal approximately the same length as a side beam 5, but preferrably slightly longer, has in one flange which is parallel to the smooth side of the frame, a plurality of spring bolts holes 25, each of which has inserted therein a loose bushing 26. As shown in FIG. 2, through the flange of the angle metal of the pressure plate 18 and through the diameter of the spring bolt holes 25 are flex-cuts 24. There are no flex-cuts in the flange through the two spring bolt holes 25 which are nearest the ends of the pressure plate 18. The spring bolts 19 have eyes on one end and are threaded on the other end. An attaching bolt 27 passes from the angle side of the pressure plate 18 through the eye in the spring bolt 19, then through the spring bolt holes 25, the loose bushing 26 therein, and is secured therein by the attaching nut 28, so that the attaching nut 28 is away from the smooth side of the frame 1. The number of spring bolts 19 is the same as the number of bolt holes 17 and the spring bolts 19 are coorespondingly spaced so that the spring bolts 19 slide into the bolt holes 17. Over each of the spring bolts 19 is a helical spring 20, and when the spring bolts 19 are inserted into the bolt holes 17, the helical springs 20 bear against the pressure plate 18 and the spring rail 16 biasing the pressure plate 18 away from the spring rail 16. The pressure plate 18 is secured to the spring rail 16 by spring nuts 21 on each spring bolt 19. It is to be noted that the pressure plate 18, by virtue of the flex-cuts 24 is to a degree, flexible and will conform to door frames which are slightly other than straight.

Between the side beams 5 on one end are two top screw rods 3. The top screw rods 3 are long threaded screws, turnable by hand or ratchet. The two screw rods 3 are threaded through matingly threaded screw blocks 22 mounted on the slotted arms 7. Each top screw rod 3 should be adjacent to a side beam 5. Also between the side beams 5 on the other end of the invention are two bottom screw rods 4 identical to the top screw rods 3, and likewise mounted in screw blocks 22, adjacent to the other ends of the side beams 5.

Figure 3:
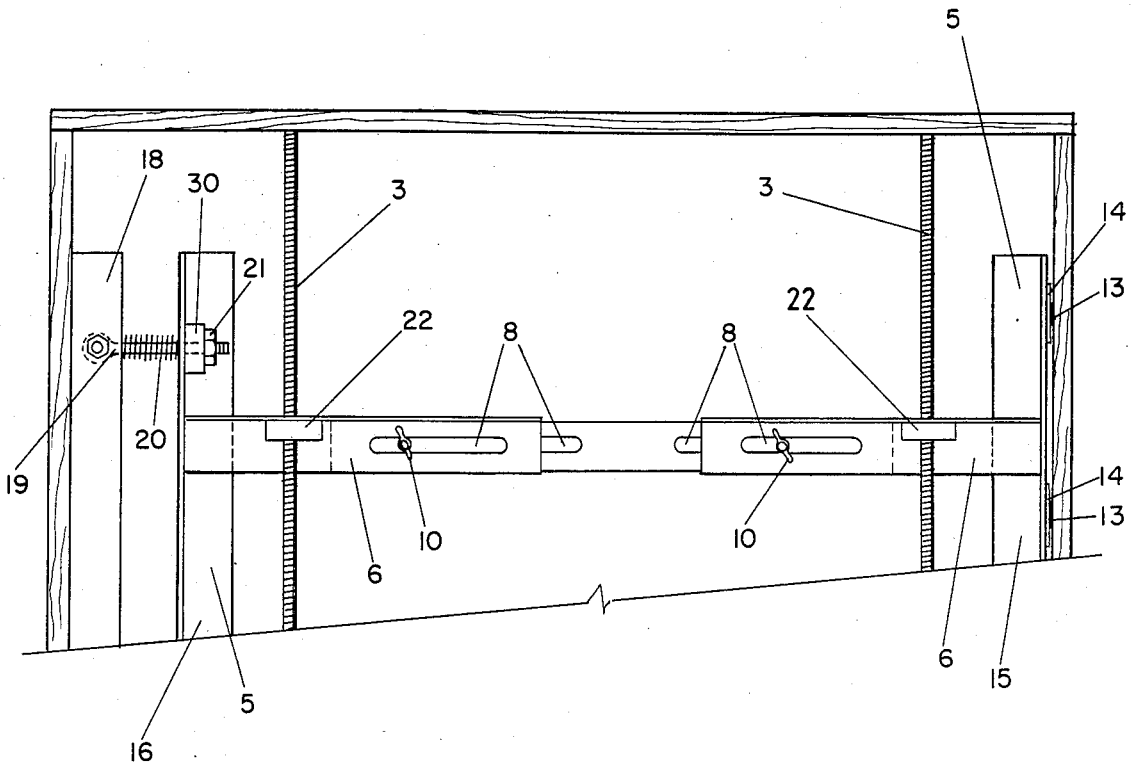
FIG. 3 is a plan view of the top of the invention in a top of a door frame.

Thus assembled, the invention is adjusted so that it is slightly wider than the door frame in which the door is to be hung, and the top screw rods 3 and the bottom screw rods 4 are screwed so that the overall length of the invention is slightly shorter than the height of the door frame. The invention is then placed in the door frame as illustrated in FIG. 3, with the pressure plate 18 being forced toward the spring rail 16 by one side of the door frame, and the clearance means 12 bearing against the other side of the door frame. The spring nuts 21 are then tightened finger tight. The top screw rods 3 are then screwed up until just touching the top of the door frame, and the bottom screw rods 4 are screwed down until just touching the floor. The invention is then removed from the door frame, and placed, smooth side next to a door, on the door. The clearance means 12 has lips 23, which are shown as a protruding part of the washers. The lips 23 protrude generally perpendicular to the overall plane of the invention, along the edge of the clearance rail 15. Thus the invention is placed on the door with a vertical edge of the door against the lips 23, and the other edge of the door scribed along the edge of the pressure plate 18. Marks are made at the protruding end of the top screw rods 3 and the bottom screw rods 4. Using any commonly available straight edge, the door is scribed through the marks. Thus scribed, the door can be easily planed top, bottom, and one edge for a precise fit with predetermined clearance. In addition the invention is easily adjustable for use in another door frame. A standard size door frame pattern can easily be adjusted for doors from two feet wide to four feet wide, and from six feet high to eight feet high. However, in general there should be a standard size frame, and outsized frames built as required for a job, since the majority of door sizes handled by professional door hangars are within a narrower size range.

I claim:

1. A door frame pattern comprising:

a frame having two side beams and a plurality of cross beams, each cross beam being two slotted arms, wherein each slotted arm is rigidly affixed at right angles to one of the side beams, each of the slotted arms having a longitudinal slot, and the slotted arms being adjustably secured to an opposing slotted arm by bolts and nuts to form the cross beams, and one of the side beams being designated the clearance rail having a clearance means with a lip protruding perpendicular to the plane of the invention, and the other side beam being designated the spring rail having a plurality of spring bolt holes disposed along its length, and a pressure plate being made of angle shaped metal, and having a plurality of spring bolt holes on one leg of the angle of the pressure plate metal, and having flex-cuts in the same leg of the angle metal through the diameters of each spring bolt hole except those adjacent to the ends of the pressure plate, and loose bushings inserted in the spring bolt holes, and spring bolts pivotally attached to the pressure plate by attaching bolts passing through the loose bushings and attaching nuts, and the number and spacing of the spring bolt holes cooresponding to the number and spacing of the bolt holes so that the spring bolts slide into the bolt holes in the spring rail, and helical springs installed over the spring bolts biasing the pressure plate away from the spring rail and the pressure plate being secured to the spring rail by nuts on the portion of the spring bolts that protrude through the spring rail, and a plurality of screw blocks affixed to the slotted arms adjacent to one end of the side beams, and a plurality of top screw rods adjustably threaded through the screw blocks, and a plurality of screw blocks affixed to the slotted arms adjacent to the other end of the side beams, and a plurality of bottom screw rods adjustably threaded through the screw blocks.

2. The invention of claim 1 wherein each of the slotted arms are adjustably connected respectively to slotted extension beams by carriage bolts and nuts, and opposing slotted arms are connected to the same extension beam.

3. The invention of claim 1 wherein the clearance means comprises four bolts with washers affixed to the clearance rail, and wherein a protruding lip is formed by the washer having a larger diameter than the flange of the clearance rail, and wherein two of the bolts are affixed to the clearance rail adjacent to the bottom end and two of the bolts are afficed adjacent to the top end.

4. The invention of claim 1 wherein the frame and pressure plate are made of angle metal.

5. The invention of claim 1 wherein the frame is made of tubular material.

6. The invention of claim 1 wherein the frame and pressure plate are made of aluminum.

7. The invention of claim 1 wherein the frame is made of channel metal.

* * * * *